US008632044B2

(12) United States Patent
Cave

(10) Patent No.: US 8,632,044 B2
(45) Date of Patent: Jan. 21, 2014

(54) PICTURE ANCHOR AND METHOD

(76) Inventor: Jerry Lynn Cave, Gilbert, AZ (US)

( * ) Notice: Subject to any disclaimer, the term of this patent is extended or adjusted under 35 U.S.C. 154(b) by 1217 days.

(21) Appl. No.: 11/717,292

(22) Filed: Mar. 12, 2007

(65) Prior Publication Data

US 2007/0210233 A1 Sep. 13, 2007

Related U.S. Application Data

(60) Provisional application No. 60/780,632, filed on Mar. 10, 2006.

(51) Int. Cl.
*A47F 1/14* (2006.01)

(52) U.S. Cl.
USPC ..... 248/467; 248/205.3

(58) Field of Classification Search
USPC ..... 248/216.4, 205.4, 205.3, 466, 467
See application file for complete search history.

(56) References Cited

U.S. PATENT DOCUMENTS

| | | | | | |
|---|---|---|---|---|---|
| 992,203 | A | | 5/1911 | Johnson | |
| 1,496,282 | A | * | 6/1924 | Taylor | 248/467 |
| 2,061,372 | A | * | 11/1936 | Wallin | 248/467 |
| 2,330,373 | A | | 9/1943 | Moore | |
| 2,334,700 | A | | 11/1943 | Frey | |
| 2,492,411 | A | | 12/1949 | Barnes et al. | |
| 2,583,129 | A | * | 1/1952 | Worth, Jr. | 40/662 |
| 2,764,817 | A | * | 10/1956 | Schwartz | 248/542 |
| 3,300,173 | A | | 1/1967 | Kennedy, Jr. | |
| 3,912,211 | A | | 10/1975 | Topf | |
| 4,026,510 | A | | 5/1977 | Holmes | |
| 4,040,149 | A | * | 8/1977 | Einhorn | 248/493 |
| 4,069,998 | A | | 1/1978 | Rytting | |
| 4,211,382 | A | * | 7/1980 | Bonfils | 248/467 |
| 4,384,648 | A | | 5/1983 | Hart et al. | |
| 4,422,608 | A | | 12/1983 | Hogg | |
| 4,619,430 | A | | 10/1986 | Hogg | |
| 4,756,498 | A | | 7/1988 | Frye | |
| 4,830,558 | A | | 5/1989 | Sweeney | |
| 4,883,247 | A | | 11/1989 | Crandall | |
| 5,029,788 | A | | 7/1991 | Hoskinson et al. | |
| 5,165,650 | A | | 11/1992 | Letizia | |
| 5,238,271 | A | | 8/1993 | Nirmel | |
| 5,269,485 | A | | 12/1993 | Dwinell et al. | |
| 5,365,682 | A | | 11/1994 | Eubank, Jr. | |
| 5,605,313 | A | | 2/1997 | Erickson et al. | |
| 5,749,558 | A | | 5/1998 | Wallo | |
| D407,012 | S | * | 3/1999 | Williams | D8/388 |
| 6,042,078 | A | | 3/2000 | Donovan | |
| 6,095,465 | A | | 8/2000 | Weck et al. | |
| 6,185,831 | B1 | | 2/2001 | Pluciennik | |
| 6,186,466 | B1 | * | 2/2001 | Baird et al. | 248/475.1 |
| 6,206,334 | B1 | | 3/2001 | Weck et al. | |
| 6,224,030 | B1 | | 5/2001 | Hepworth | |

(Continued)

*Primary Examiner* — Bradley Duckworth
(74) *Attorney, Agent, or Firm* — Stuart Whittington

(57) ABSTRACT

A picture anchor may include a fastener such as a pin, nail or tack and a non-metallic bumper pad connected to the non-sharp end of the fastener. The anchor is adapted so a back surface of the bumper pad may be attached to a back surface of an object for hanging. A user may then press the object for hanging against the mounting surface, such as a drywall surface, to force the sharp end of the fastener to penetrate the surface thereby anchoring the object to the wall. The bumper pad(s) will provide a uniform space between the hanging object and the mounting surface and serve as a shock absorber to prevent the hanging object from vibrating or rattling.

12 Claims, 4 Drawing Sheets

(56) References Cited

U.S. PATENT DOCUMENTS

| | | | | |
|---|---|---|---|---|
| 6,471,169 | B1 * | 10/2002 | Maloney | 248/205.3 |
| 6,641,105 | B1 * | 11/2003 | Hamerski | 248/452 |
| 6,719,260 | B1 | 4/2004 | Hart | |
| 6,758,455 | B2 | 7/2004 | Weck et al. | |
| 6,880,795 | B1 | 4/2005 | Haynes, III | |
| D506,919 | S | 7/2005 | Munson et al. | |
| 6,952,887 | B2 | 10/2005 | Muchnik | |
| 2001/0038061 | A1 * | 11/2001 | Astell | 248/466 |
| 2002/0092957 | A1 * | 7/2002 | Martorelli | 248/308 |
| 2004/0216319 | A1 | 11/2004 | Muchnik | |
| 2005/0006552 | A1 * | 1/2005 | Giles | 248/467 |
| 2005/0263654 | A1 * | 12/2005 | Grillo | 248/205.3 |

* cited by examiner

PICTURE ANCHOR AND METHOD

CROSS-REFERENCE TO RELATED APPLICATIONS

This application claims benefit of priority under 35 U.S.C.§119(e) to U.S. Application Ser. No. 60/780,632 entitled, "Picture Perfect Wall Hanging Anchors," which was filed by the instant inventor on Mar. 10, 2006.

BACKGROUND OF THE INVENTION

1. Technical Field

The present invention generally relates to a device for aligning and securing objects to a vertical wall. More particularly, but not exclusively, the present invention discloses embodiments for mounting picture frames and/or other objects to relatively penetrable wall surfaces such as those made of gypsum board or plasterboard, commonly referred to as "drywall" or "sheet rock," although the inventive embodiments are not limited to any particular surface.

2. Background Art

Many different types of devices are known for hanging or mounting pictures or artwork to interior walls. Most of these devices focus on mechanisms which utilize a single primary anchor, e.g., a nail, screw or other hanger device located at one point on the wall. For example, pictures or wall hangings that are hung with a cable or single bracket. These type of mounting mechanisms may allow a picture to inadvertently move by virtue of a nail becoming dislodged, the slam of a door or window, by dusting, or even from airborne vibrations.

Thus while conventional hanging devices may work well for hanging an object on the wall, most of these devices leave the hanging object susceptible to becoming misaligned or out of position due to one or more of the previously-mentioned reasons.

While some bracket types and related mechanisms have been previously proposed to reduce the potential for incidental picture misalignment, many of them require precise measuring and often leave behind multiple or large screw/nail holes. Further, even some prior art anchor solutions which do not allow significant movement of a hanging are prone to rattling when vibrations occur and/or fail to provide uniform spacing between the picture and wall surface. There is an ongoing need for a simple, inexpensive mechanism to securely affix objects to walls or other surfaces, absorb vibrations, provide improved spacing, and which leaves little noticeable impact on the wall surface when removed.

BRIEF DESCRIPTION OF THE DRAWING

Aspects, features and advantages of the inventive embodiments will become apparent from the following description of the invention in reference to the appended drawing in which like numerals denote like elements and in which.

DETAILED DESCRIPTION OF THE INVENTION

Figure 1:
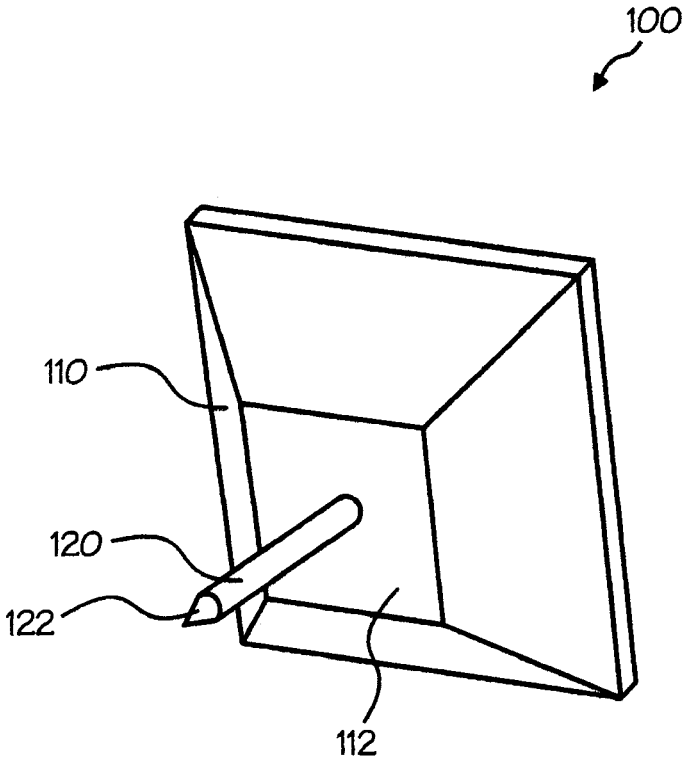
FIG. 1 is a perspective view of an exemplary picture anchor according to one aspect of the present invention.
Figure 2:
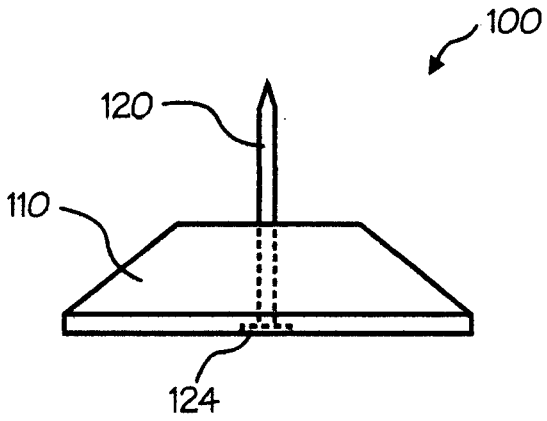
FIG. 2 is a side view of the picture anchor in FIG. 1.
Figure 3:
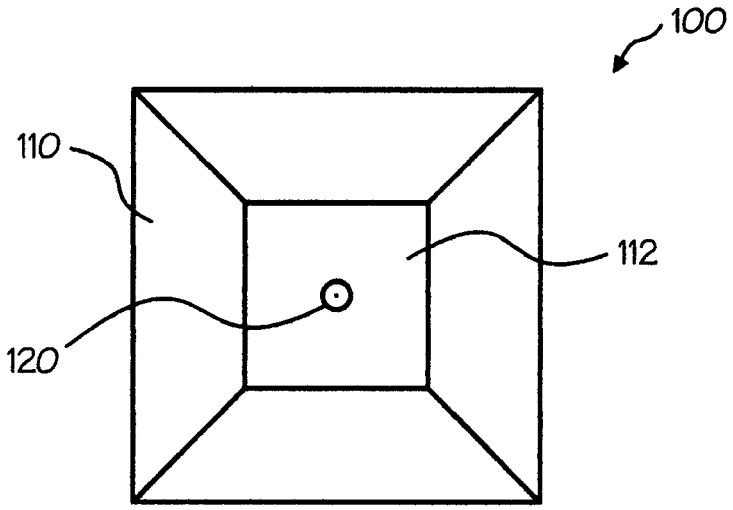
FIG. 3 is a top plan view of the anchor of FIGS. 1 and 2.

Referring to FIGS. 1-3, a picture anchor 100 according to one embodiment of the present invention may include a bumper pad 110 and a fastener 120 connected at one end to bumper pad 110.

Bumper pad 110 serves as a base to support fastener 120 add for attaching fastener 120 to an object to be mounted. In preferred embodiments bumper pad 110 is formed of a non-metallic, preferably, somewhat pliable material such as a soft plastic, cloth, rubber or silicone material and shaped to serve as guard, pad or disk to absorb vibrations and provide spacing between the object to be mounted and a corresponding wall surface.

Fastener 120 may have a form similar to a pin, tack or nail and may include a first pointed or sharp end 122 and a second, blunt, capped, or headed, opposite end 124. Opposite end 124 of fastener 120 may be embedded within at least a part of bumper pad 110, as best shown in the example embodiment of FIG. 2. In certain embodiments, fastener 120 may be formed of metal such as a stainless or galvanized steel or other metal having a rigidity and strength suitable for penetrating wall surfaces such as sheet rock and the like.

In various embodiments bumper pad 110 may be formed in a polygonal shape such as a square, rectangle, trapezoid or triangle. In other embodiments, bumper pad 110 may be formed in an oval or round disk shape. Bumper pad 110 includes a front (e.g., wall-facing) surface 112 and a rear (e.g., picture or other object-to-be-secured facing surface 116 (FIG. 4).

Figure 4:
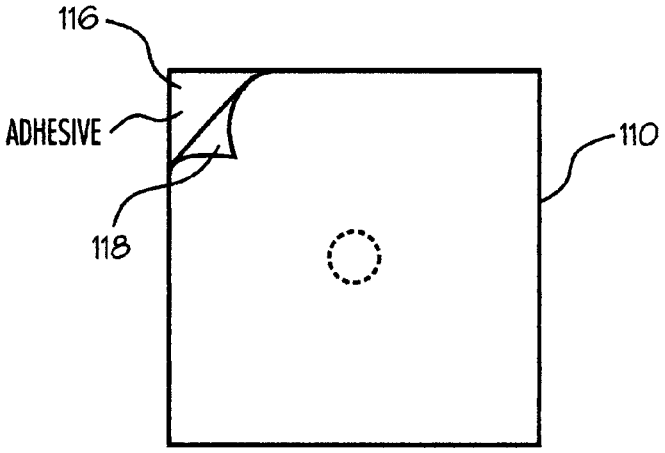
FIG. 4 is a back view of the anchor of FIGS. 1-3.

Although not required, referring to FIG. 4, rear surface 116 of bumper pad 110 may including a fixing mechanism 116 to enable a user to attach anchor 100 to an object to be mounted. In one example implementation, fixing mechanism 116 may include a tacky bonding agent or quickset adhesive such as contact cement or other type of adhesive suitable for affixing anchor 100 to a desired object. In this embodiment, anchor 100 may thus also include a temporary backing 118 such as a wax or plastic-coated paper, or other type of non-stick disposable material. Accordingly, when a user is ready to attach anchor 100 to an object for mounting, they may simply peel away backing 118 and adhere anchor 100 where desired.

In alternate embodiments, fixing mechanism 116 may comprise other bonding mechanisms such as a segment of hook and loop material, double-sided tape, a magnet, putty, pin, hook or other materials which may be known to fasten one object to another. However, if included, preferably fixing mechanism 116 is selected to be a non-permanent or light-hold bonding agent so that anchor 100 may be used and removed from the back a picture frame (or other object) without causing damage to the object. In this manner, anchor may be repeatedly used on different picture frames as desired and may be refastened to new surfaces simply by applying contact cement or other agent, if necessary, to rear surface 116 and/or a corresponding surface of the picture frame.

In certain embodiments such as the example of FIGS. 1-3, a surface area of front surface 112 of bumper pad 110 is significantly less than a surface area of rear surface 116. In the square-shaped example of FIGS. 1-3, this results in tapered square form which has two primary benefits. First, a reduced surface area of front surface 112, which will touch the wall (or other surface) when the object is mounted, will be less likely to adversely impact the wall surface (via impressions or removal of wall coatings) if/when the object mounted with anchors 100 is ever removed. Second, an enlarged surface area of rear surface 116 (in proportion to the front surface) may facilitate a stronger adhesive bond between anchor 100 and the object to be mounted as it allows for a larger adhesion area. This is particularly advantageous when lower-hold or non-setting adhesive is used in order to be able to remove anchors 100 from the object at a later time.

Figure 5:
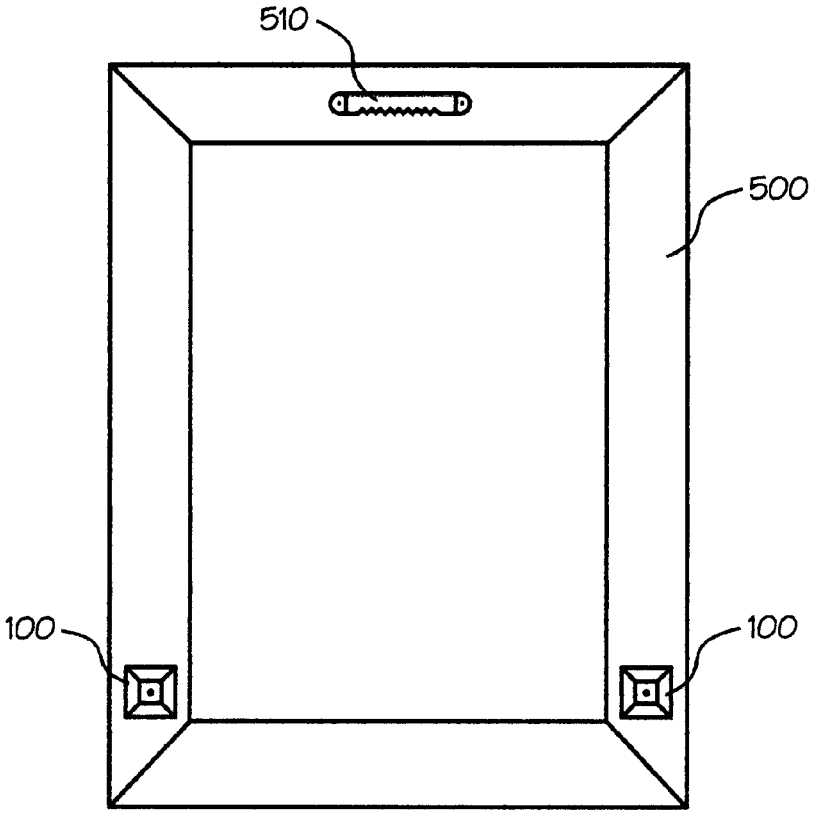
FIG. 5 is a view of the anchor of FIGS. 1-4 being used in an example environment.

A thickness of bumper pad 110, for example, the distance between rear surface 116 and front surface 112, may selected to be thick enough to capture and/or stabilize head 124, if any, of fastener 120. In preferred embodiments, the thickness of bumper pad 110 may be selected to also provide a substantially parallel space between the hanging (e.g., picture frame 500; FIG. 5) and the wall surface when a hanger (e.g., bracket 510) is also mounted on the back of frame 500. In one embodiment, bumper pad 110 may be comprises of a silicone material having a thickness of approximately 0.025 inches, with a maximum length of 0.5 inches, although the inventive embodiments are not limited to any particular size. In fact bumper pad 110 and associated fastener 122 may be made in various different sizes to accommodate securing of objects of various sizes and weights. Fastener 120 may be molded into the bumper pad 110 during manufacture, or may be driven in from rear surface 116 with the aid of a simple jig.

An example environment and method for use of picture anchor 100 will now be explained in reference to FIGS. 4 and 5. As previously mentioned, when ready to use, a user will remove adhesive protective backing 118 (FIG. 4). Exposed adhesive surface 116 is then pressed firmly to a location on the back side of picture frame 500 to affix anchor 100. As shown in FIG. 5, more than one anchor 100 may be used, depending on the size of frame 500. With the arrangement of bracket 510, a preferred location for anchor(s) 100 is on a bottom edge or lower side(s) of frame 500.

Frame 500 may then be hung on the wall by its accompanying cable or bracket (e.g., bracket 510) as would be conventionally performed. At this point, the user may vertically align frame 500, by eye or with the potential aid of a level, on the wall.

Once the desired vertical alignment is determined, the front portion(s) of frame 500 (corresponding to the location of anchor(s) 100 on the reverse side) are pushed into the wall, thereby inserting the sharp ends of fastener 120 into the sheet rock or other surface material. The result is a mounted picture frame 500 which will not incidentally move due to external forces. Further, because of the shock absorbing properties of nonmetallic, relatively pliable, bumper pad 110, vibrations may be absorbed which would not be by anchor devices which are made of rigid materials such as metal. Additionally, bumper pads 110 serve to provide a space between frame 500 and the wall surface. Accordingly, with embodiments of the present invention, rattling of pictures against the wall surface to which they are mounted can be significantly reduced, if not altogether prevented.

Because, in this example, anchors 100 are not used in a supporting fashion (which is accomplished in FIG. 5 via bracket 510) but rather primarily to serve an alignment and anchoring function, fastener 120 can be made much more narrow than conventional nails or screws used to hang items. This allows for a relatively easy insertion into a sheetrock surface. An additional benefit of using relatively narrow fasteners 120 is that if frame 500 is removed from the wall surface, only one or two pin-sized holes are left in the wall. Accordingly, the impact of using anchors 100 is far less obvious than the nail(s) or screws which may be used to hang frame 100 via bracket 510. Additionally, damage to the surface of the sheet rock, or removing surface paint or wall paper, as may happen with double sided adhesive, may be avoided.

Figure 6:
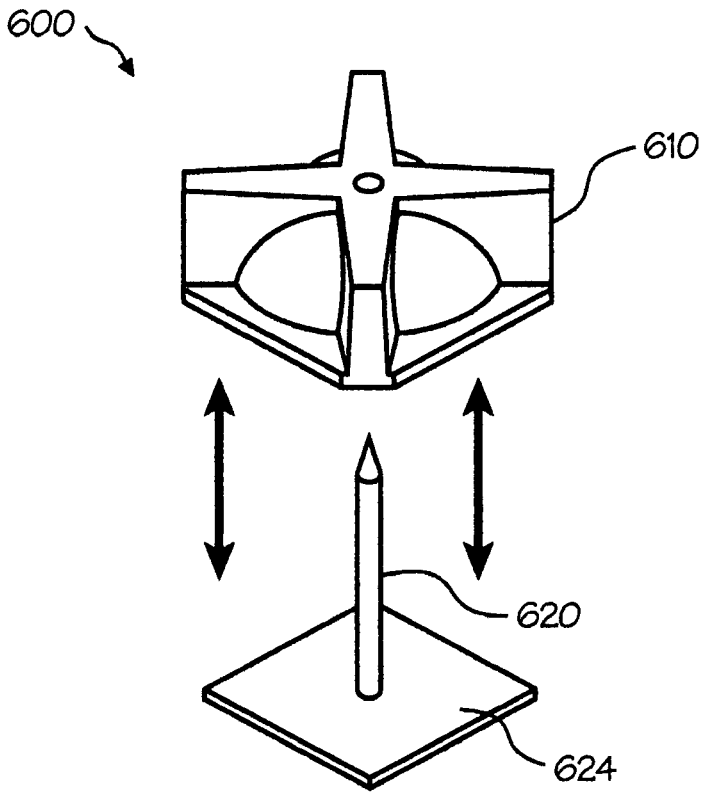
FIG. 6 is a perspective view of a modified embodiment for a picture anchor according the various aspects of the invention.

Turning to FIG. 6, another example embodiment is shown for a picture anchor 600 according to the present invention. Anchor 600 is similar to that previously described and includes a shock absorbing bumper pad 610 and accompanying fastener 620. This embodiment shows fastener 620 having an enlarged head 624 and bumper pad 610 having a reduced front (wall facing) surface area by virtue of its X-shape. Anchor 600 does not have any functional advantages over previously described anchor 100 (FIGS. 1-5) but may, in certain cases, be easier and more cost efficient to manufacture. Accordingly, various sizes and shapes of wall anchors, not expressly discussed herein, could be used without departing from the scope of the inventive embodiments.

Unless contrary to physical possibility, the inventor envisions the components of respective embodiments may be combined in any manner.

Although there have been described preferred embodiments of this novel invention, many variations and modifications are possible and the embodiments described herein are not limited by the specific disclosure above, but rather should be limited only by the scope of the appended claims.

What I claim is:

1. A picture anchor to secondarily secure a picture frame that has an existing primary hanger system to a wall, the picture anchor comprising:

a single-piece silicone bumper pad comprising, (i) a front surface to, contact the wall, (ii) an adhesive laden rear surface parallel to the front surface to adhere the picture anchor to the picture frame, and (iii) one or more tapered side surfaces connecting respective peripheries of the front and rear surfaces in a manner that the front surface has a substantially smaller surface area than the rear surface to reduce an area of the front surface that will contact the wall and detrimentally impact a corresponding wall coating and to have a larger adhesive area of the rear surface that will contact the picture frame to utilize a lower bond adhesive, wherein the thickness of the silicone bumper pad is proportionate to a size of the picture frame and the primary hanger system to provide substantially parallel spacing between the wall and the picture frame and to absorb vibrations between the picture frame and the wall; and a fastener having a headed end and a sharp end, the headed end being permanently and non-movably embedded within the silicone of the bumper pad, the fastener extending perpendicularly and through to the front surface with the sharp end being exposed such that, when the rear surface of the bumper pad is adhesively attached to a back surface of the picture frame, and the frame is secured to the wall with the primary hanger system, pressure applied to a front surface of the picture frame will force the sharp end of the fastener to penetrate the wall and secure the picture frame.

2. The picture anchor of claim 1 wherein the adhesive laden rear surface is the only adhesive present on the picture anchor.

3. The picture anchor of claim 1 wherein the bumper pad is formed of a tapered block of silicone having a consistency that substantially retains its shape but capable of absorbing vibrations.

4. The picture anchor of claim 1 wherein the front surface is formed to have an X-shape to further reduce the area of the front surface that will contact the wall.

5. The picture anchor of claim 1 further comprising a disposable backing material to protect the adhesive laden rear surface until ready for use.

6. An anchor to mount a picture frame to a mounting surface, the anchor comprising:

a pin having a sharp end and a headed end;

a silicone bumper pad having the headed end of the pin permanently embedded therein and having a front surface through which the pin extends outward and a rear surface having a layer of non-permanent adhesive to be attached to a back of the picture frame such that, when attached to the back of the picture frame, the pin may be pushed into the mounting surface by applying pressure to a front of the picture frame, wherein the silicone bumper pad is formed of a single block of silicone and configured such that the front surface of the silicone bumper pad has a substantially smaller surface area than the rear surface to reduce an area of the silicone bumper pad that will contact the mounting surface and have a larger surface area for the layer of non-permanent adhesive to contact the picture frame, and wherein the thickness of the silicone bumper pad between the front and rear surfaces is selected to absorb vibrations between the picture frame to be mounted and the mounting surface and to provide substantially uniform spacing between the picture frame when the picture frame is mounted on the mounting surface with a separately provided primary picture frame mounting hanger.

7. The anchor of claim 6 wherein the layer of non-permanent adhesive on the rear surface is the only adhesive present on the anchor.

8. The anchor of claim 6 wherein the thickness of the silicone bumper pad is approximately 0.025 inches.

9. The anchor of claim 6 wherein the silicone bumper pad comprises a tapered block having one or more angled sides connecting respective peripheries of the front and rear surfaces.

10. The anchor of claim 6 wherein the front surface of the silicone bumper pad has an X-shape to reduce the surface area of the silicone bumper pad that contacts the wall.

11. A method of secondarily securing a picture frame having an existing primary hanger system on a drywall surface, the method comprising:

peeling a backing paper off an adhesive-coated rear surface of a first anchor pin comprising a single-piece silicone bumper pad having a fastening pin permanently embedded therein and extending through and outward from a front surface of the silicone bumper pad, the bumper pad having a thickness selected to absorb vibrations between the framed picture and the drywall surface;

pressing the rear surface of the first anchor pin on a lower corner of a back of the picture frame;

peeling a backing paper off an adhesive-coated rear surface of a second anchor pin identical to the first anchor pin;

pressing the rear surface of the second anchor pin on a lower opposite corner of the back of the picture frame;

hanging the picture frame on the drywall surface via the primary hanger system;

aligning the picture frame as desired; and pressing front portions of the picture frame, at substantially the location that the first and second anchor pins are attached on the lower back corners, to insert the fastening pin into the drywall surface.

12. The method of claim 11 further comprising, before peeling the backing paper off the first anchor pin, selecting a size of anchor pins to use based on a size of the picture frame and its primary hanger system to achieve substantially uniform spacing between the drywall surface and the picture frame when mounted.

* * * * *